United States Patent [19]

Maharshak

[11] Patent Number: 4,652,865

[45] Date of Patent: Mar. 24, 1987

[54] CARD HOLDER

[76] Inventor: Arie Maharshak, P.O. Box 135, Shave-Zion 25227, Israel

[21] Appl. No.: 828,847

[22] Filed: Feb. 12, 1986

[51] Int. Cl.[4] ..... G08B 13/14

[52] U.S. Cl. ..... 340/568; 200/61.19

[58] Field of Search ..... 340/568, 569; 200/61.59, 61.63, 61.19, 250, 151; 335/205, 206, 207, 306

[56] References Cited

U.S. PATENT DOCUMENTS 3,959,789 5/1976 McGahee ..... 340/568 X

*Primary Examiner*—Glen R. Swann, III

*Assistant Examiner*—Thomas J. Mullen, Jr.

*Attorney, Agent, or Firm*—Frishauf, Holtz, Goodman & Woodward

[57] ABSTRACT

A credit card holder composed of a series of transparent pockets is provided with an alarm system warning the owner that a card was not returned into its pocket. Each pocket is provided with two electric contact strips attached to the inside of the pocket walls which are separated by the credit card inside the pocket and are in contact whenever the card is withdrawn. The card holder contains a battery, a buzzer and a timer suitably connected to the contact strips. This timer serves to delay energizing of the buzzer for a time period in which the transaction can be reasonably accomplished, and sounds the alarm only then.

15 Claims, 7 Drawing Figures

A-A SECTION

B-B SECTION

CARD HOLDER

The invention relates to the guarding of documents in card-form in a card holder composed of a series of separate, flat and transparent compartments or pockets which are interconnected either in book- or in strip-form as well as in the shape of a cigarette pack; the card holder is either fixedly connected to the inside of a wallet or is loosely carried in a lady's handbag. These card holders are used for carrying identity cards, credit cards, driver's licences and similar cards of small size or in folded state, each in one of the transparent or partly transparent pockets, so as to be readily visible and withdrawable for use and/or presentation.

A person carrying a number of such cards is liable to forget returning a card into its appropriate pocket after having used it for payment or for presentation, or the person handed the card may forget to return it to the bearer. The present invention has as its object to remind the bearer that a specific card is missing from its compartment, by means of a visual or audible signal after elapse of a predesignated time interval from the moment the card has been with-drawn.

The invention consists of a cardholder comprising a series of flat, rectangular pockets, each pocket being composed of two adjoining walls of a non-conducting material, at least one of these walls being transparent, said two walls being firmly interconnected along three sides of the rectangle, while the fourth side is open to permit insertion and withdrawal of one card each. The pockets are assembled in strip-form or book-form or in the shape of a cigarette pack, and are characterized by that the walls of each pocket are urged together by spring means or by magnetic means. Each pocket is provided on its inside on opposite walls with contact pieces which are normally separated by a card inserted into the pocket and are urged into mutual contact as soon as the card is withdrawn.

All contact pieces are connected in parallel to an electric alarm system which comprises at least one timer, an electric cell, a starter adapted to trigger and to reset the timer, and an indicator adapted to emit an audible or visual signal. and an indicator adapted to emit an audible or visual signal. The circuit is adapted to start the timer as soon as the opposed contacts touch, and the timer is set to energize the alarm from the cell to the indicator after a predesignated period. The indicator then emits a signal warning the bearer that a certain card has not been returned into its compartment. The signal is emitted until the card has been returned and opens the circuit between the two contact pieces, where-upon the signal is stopped.

In a preferred embodiment of the cardholder composed of a plurality of interconnected pockets, only one electric circuit is provided in respect of all pockets, the contact pieces being all connected to the alarm circuit by wiring, either in printed form or in the form of metal wires. The contact pieces are generally in the form of two thin metal discs fastened, e.g. by gluing, to the inside of the pocket walls. Alternatively they may be metal-printed on the walls by a method known to the art. One of the metal discs is preferably in the form of a permanent magnet which serves to attract the opposite contact piece of a magnetic material as soon as the specific card is withdrawn. The discs are preferably in staggered position in respect of adjoining pockets in order not to increase the thickness of the cardholder in closed state.

The walls of the pocket consist preferably of a resilient, transparent plastic which lends itself to be readily bent for inserting or withdrawing a card.

In case the pockets are arranged in strip-form, the portion between each two pockets is flexible so as to permit the strip to be folded into a pack wherein all pockets are assembled in parallel alignment in close proximity. The strip-shaped cardholder is preferably connected at one of its ends to the inside of a wallet or a lady's handbag. The cardholder in book-form generally forms a portion of a wallet which, upon being opened, discloses the cards through the transparent walls and permits the bearer to select the required card.

In another embodiment each wall of one pocket consists of an inner and an outer layer of a transparent, non-conductive material, the space between the layers serving to carry the connecting wires from the contact pieces to the alarm system in electrically insulated state as well as two leaf springs adapted to urge the pocket walls together.

In the accompanying drawings which illustrate, by way of example only, several embodiments of the invention.

Figure 1:
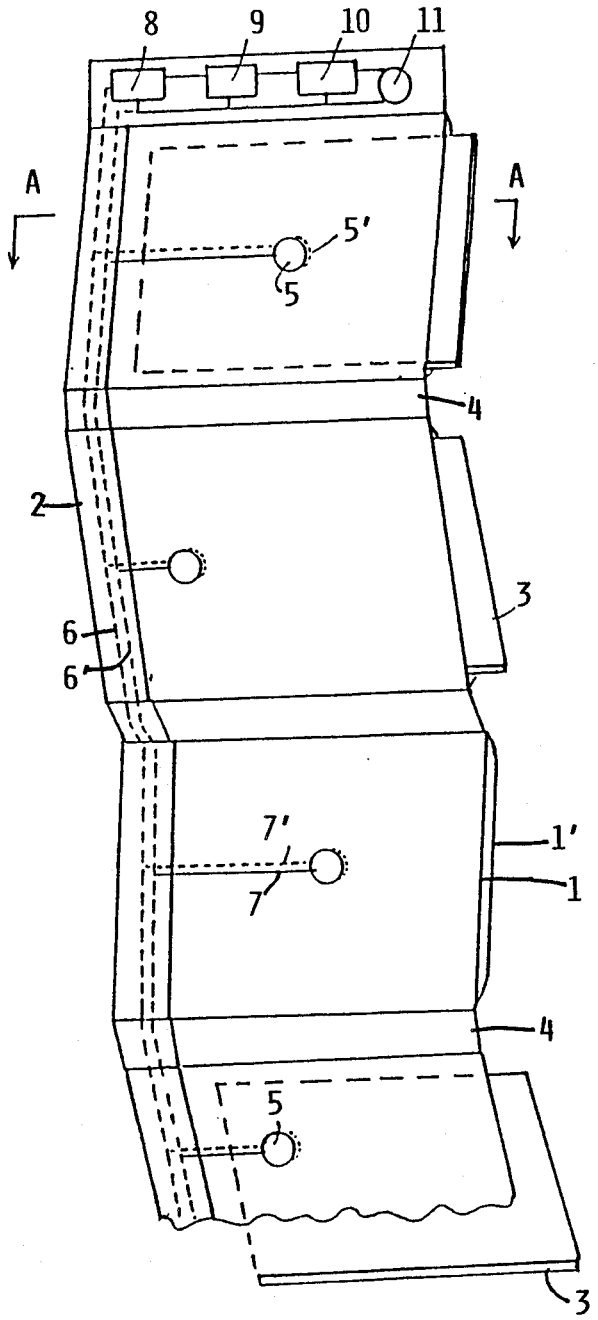
FIG. 1 shows a portion of the cardholder in strip form.
Figure 2:
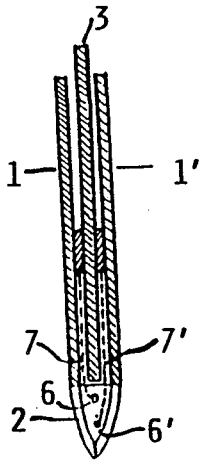
FIG. 2 is a section along the line A—A of FIG. 1.

FIGS. 1 and 2 of the drawings illustrate a strip-shaped cardholder showing three whole and one broken-off pocket, but it will be understood that a larger number may be provided according to the number of cards to be accommodated. The card pockets are formed between two strips of a flexible material, preferably cut from plastic sheeting, forming the walls 1, 1', at least one of these walls being transparent. The pockets are formed by heat-welding the two strips along one edge, 2, and across the strips along transverse portions 4 extending between each two adjoining pockets, the pockets being open at the side opposite the edge 3. Cards 3 are shown to be inserted into three of the pockets, while the fourth pocket is empty, permitting the contact discs 5, 5' to touch each other. One contact disc 5, 5' each is attached to the inside of the walls 1, 1' of each pocket and are electrically connected by wires 6, 6', 7,7', to an alarm system provided between the two strips at the extreme end of the strips. The alarm system comprises a starter 8, a timer 9, an indicator 10, and an electric cell 11. These components are interconnected in a manner that closing of the contacts 5, 5', energizes the starter 8 which emits a signal to the timer 9. The timer is set to a given time period, whereafter it closes the circuit between the cell 11 and the indicator 10. As soon as a card 3 is inserted into one of the pockets, the contact pieces 5, 5' are separated, and current ceases to reach the indicator, whereupon the signal is stopped. One of the contact pieces, for instance disc 5, is in the form of a permanent magnet which attracts the opposite contact disc 5', whenever the card 3 is extracted, thereby closing the circuit to the alarm system and energizing it. It is understood that the time period set to sound the alarm must be sufficient to allow for operation of any card; for instance it must be sufficiently long for inserting a credit card into a bill and for signing it.

A switch, not shown, may be provided so as to interrupt the connection between the cell and the other components, so as to prevent an alarm signal from being given, if the bearer so decides.

Figure 3:
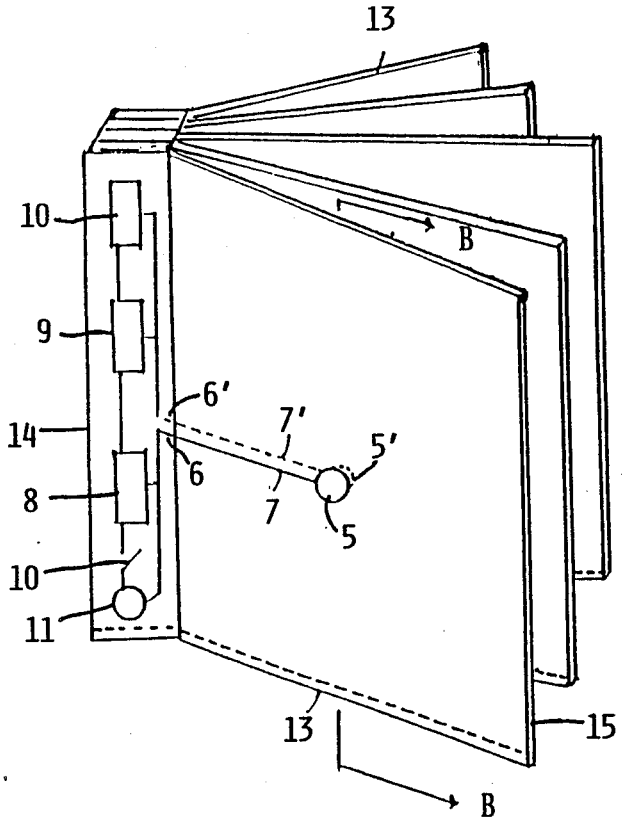
FIG. 3 shows a cardholder in book form.
Figure 4:
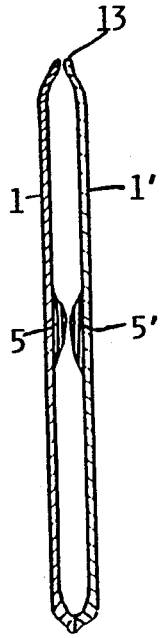
FIG. 4 is a section along line B—B of FIG. 3.

FIGS. 3 and 4 illustrate a card holder comprising five pockets arranged in book-form. Herein the several components of the alarm system are identical with those shown in FIGS. 1 and 2, and they are, therefore, designated by identical numerals. Each pocket is formed by heat sealing two rectangular pieces of plastic along their opposite edges 13 and 13', while their rear ends 14 are similarly heat welded, enclosing the alarm system. In the present case no cards are shown inserted into the pockets through their open ends 15, causing all contacts to be closed. In this state a switch 16 is required to be opened so as to prevent the cell 11 from energizing the system.

Figure 5:
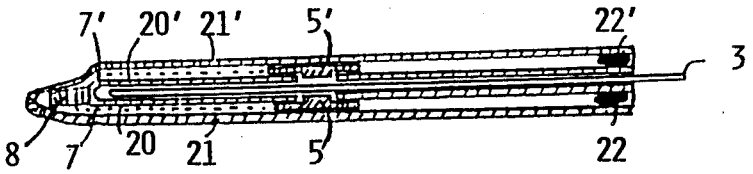
FIG. 5 is a cross section through a pocket provided with doublelayer walls.

FIG. 5 illustrates a different kind of pocket characterized by that its walls are doubled, comprising an inner layer of material 20, 20', and an outer layer 21, 21'. The inner layers are perforated by circular holes through which penetrate the ends of the stepped contact pieces 5, 5', thus projecting by a short distance only into the space and facilitating the insertion of cards.

In the present embodiment the contact pieces need not be magnetic, since the two walls are pressed together by two leaf springs 22, 22' inserted into the spaces between the outer and inner layers 20, 21 and 20', 21'. This embodiment, using spring closure, is particularly suitable for contacts and wiring printed onto the inside of the walls. The printing process may be carried out similar to that used in the manufacture of printed circuits in electronic apparatus and is suitable both for the card holder of FIG. 1 and FIG. 3, causing the specific pockets to be very thin.

Figure 6:
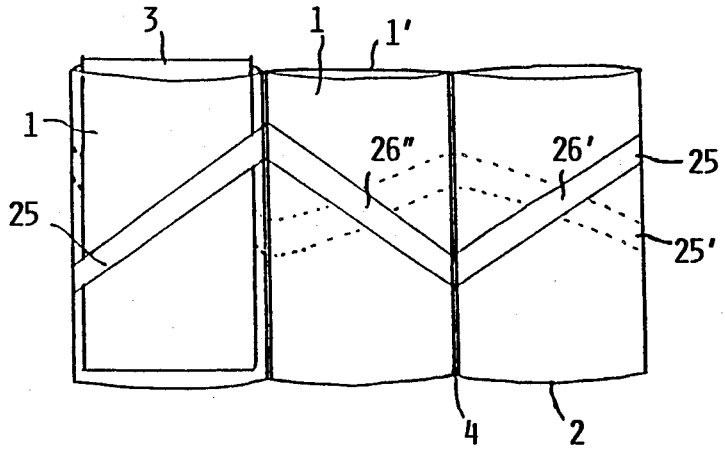
FIG. 6 illustrates another embodiment of the cardholder in strip form as shown in FIG. 1.

FIG. 6 shows a cardholder in strip form similar to that illustrated in FIGS. 1 and 2, and identical numerals are used to identify identical parts of the two cardholders. Opposing contact points are formed by two conductor strips 25 and 25' attached to the inside of the opposite pocket walls 1 and 1' in zigzag form, whereby the strips inside every pocket cross each other at points 26', 26'' etc. The strips are connected at their one end to the terminals of an electronic alarm system which is similar to those systems shown in FIGS. 1 and 3.

The strips 25, 25' are separated by the cards 3 inserted into the pockets, and contact is made at one of the points, such as 26' or 26'', in any pocket out of which a card has been withdrawn. The contact will cause a current to pass through the alarm system which will sound an alarm after a programmed period of delay, serving to warn the bearer of the absence of a card. Only after the card has been replaced inside the pocket will the alarm cease to sound.

Figure 7:
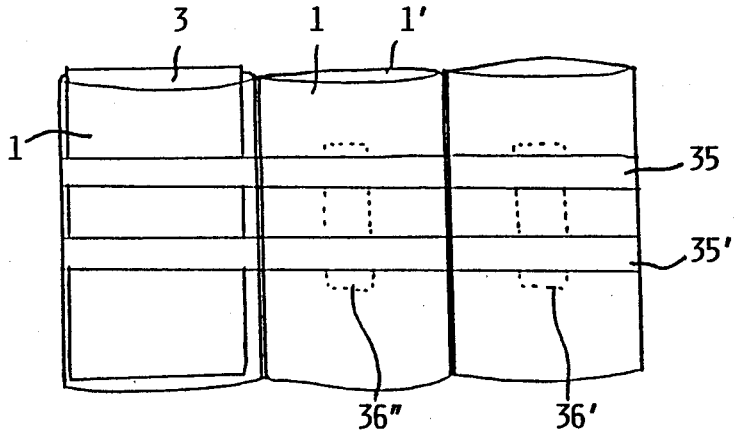
FIG. 7 illustrates still another embodiment of the cardholder in strip form as shown in FIG. 1.

The cardholder of FIG. 7 is built on a similar principle. Two conductive strips 35 and 35' are fastened to the inside of the walls 1 of the pockets in the strip-shaped cardholder. Conductive strips 35 and 35' are in a parallel spaced relationship to each other and extend through all pockets of the cardholder, their ends at one side of the cardholder being attached to an electronic alarm system which is similar to those shown in FIGS. 1 and 3. Short conductive strips 36', 36'' etc. are fastened to the inside of the walls 1' of all the pockets. Strips 36', 36'' are perpendicular to the strips 35, 35' and in overlapping alignment thereto. When a pocket is emptied and the card ceases to separate conductive strip 36', for example, from the conductors 35 and 35', the strip 36' makes contact with them, thereby forming an electrical connection. Current can then flow through conductive strips 35, 36' and 35' to actuate an alarm, after a predetermined delay period.

It will be understood that the same or a similar alarm system may be employed in respect of files holding important documents, producing a sign in case the document is not returned to the file after a given time interval.

Other modifications and alterations may be carried out to the invention, by a person skilled in the art, within the spirit of the invention and the scope of the following claims.

I claim:

1. An alarm system for a cardholder comprising a series of flat, rectangular pockets, each pocket being composed of two adjoining walls, said two walls being interconnected along three sides, while the fourth side is open to permit insertion of a card, two flat contact bodies respectively attached to the inside of each of said pocket walls in opposed alignment, one of said bodies being a permanent magnet and the other of said bodies being made of a magnetic material, said contact bodies being normally separated by an inserted card in each pocket, each of said contact bodies being electrically connected to an indicator circuit means located in a portion of said cardholder, said indicator circuit means being electrically triggered to emit an audible or visual signal upon contact being established between said contact bodies in one pocket, at a predesignated time interval from the moment a card is extracted from said pocket.

2. The alarm system of claim 1, wherein said indicator circuit means comprises an electric cell, a timer, a starter adapted to trigger and to reset said timer, and an indicator, said timer being set to said predesignated time interval.

3. The alarm system of claim 1, wherein said contact bodies are in the shape of flat metal discs.

4. The alarm system of claim 1, wherein said contact bodies are in the form of a metal layer printed on the inside of said walls of said pockets.

5. The alarm system of claim 4, wherein the walls of each of said pockets are urged together by means of leafsprings positioned in said walls.

6. An alarm system for a cardholder comprising a series of flat, rectangular pockets arranged in a single, substantially rectangular strip having opposite ends, each pocket being composed of two adjoining walls, said two walls being interconnected along three sides, while the fourth is open to permit insertion of a card and lies on an edge of said strip extending between said opposite ends, two longitudinal flat conductors spaced from each other and attached to the inside of a first of said two adjoining pocket walls and extending continuously between said opposite ends along substantially the entire strip formed by said pockets between said opposite ends, a third flat conductor attached to the second of said two adjoining walls in each of said pockets so as to overlap both of said two longitudinal conductors, said two adjoining pocket walls in a given pocket corresponding to any one of said pockets being adapted to be normally separated by a card inserted into the given pocket to prevent the third flat conductor from contacting the two longitudinal conductors yet having the two adjoining walls movable toward each other upon the card being withdrawn from said given pocket to have the third flat conductor contact the two longitudinal conductors and span the space therebetween, said two longitudinal conductors being electrically connected to an indicator circuit means located in a portion of said cardholder, said indicator circuit means being electrically triggered to emit an audible or visual signal upon contact being established between the third flat conductor and said two longitudinal conductors at a predesignated time interval from the moment a card is extracted from a pocket.

7. The alarm system of claim 6, wherein said two longitudinal flat conductors are parallel to each other and said third flat conductor is aligned perpendicularly thereto.

8. The alarm system of claim 6, wherein said indicator circuit means comprises an electric cell, a timer, a starter adapted to trigger and to reset said timer, and an indicator, said timer being set to said predesignated time interval.

9. The alarm system of claim 6, wherein the walls of each of said pockets are urged together by means of leafsprings positioned in said walls.

10. An alarm system for a cardholder comprising a series of flat, rectangular pockets arranged in a single substantially rectangular strip having opposite ends, each pocket being composed of two adjoining walls, said two walls being interconnected along three sides, while the fourth side is open to permit insertion of a card and lies on an edge of said strip extending between said opposite ends, a first flat longitudinal conductor attached to the inside of one of said two adjoining pocket walls and extending continuously between said opposite ends along substantially the entire strip formed by said pockets, a second flat longitudinal conductor attached to the inside of the other of said two adjoining pocket walls and extending continuously between said opposite ends along substantially the entire strip formed by said pockets, said first and second longitudinal conductors being aligned so as to overlap in at least one point in each pocket, said two adjoining pocket walls in a given pocket which corresponds to any one of said pockets being adapted to be normally separated by a card inserted into said given pocket to prevent the first and second flat longitudinal conductors from contacting each other yet having the two adjoining walls movable toward each other when said card has been extracted from said given pocket to have the first and second flat longitudinal conductors contact each other in at least one point in said given pocket, each conductor being electrically connected to an indicator circuit means located in a portion of said cardholder, said indicator circuit means being electrically triggered to emit an audible or a visual signal upon contact being established between said firs and second flat longitudinal conductors in said given pocket at a predesignated time interval from the moment a card has been extracted from said given pocket.

11. The alarm system of claim 10, wherein at least one of said first and second conductors is angled in a given direction so as to be non-parallel relative to said fourth side.

12. The alarm system of claim 11, wherein both of the first and second conductors are non-parallel relative to said fourth side, are angled in opposite directions relative to each other, and are positioned so as to overlap at only one point in each of said pockets.

13. The alarm system of claim 12, wherein each of said first and second conductors includes one portion in one of said pockets and a second portion in a pocket adjacent to said one pocket, said first and second portions being connected at the side common to the one pocket and its adjacent pocket, and said first and second portions being angled in opposite directions relative to each other.

14. The alarm system of claim 10, wherein said indicator circuit means comprises an electric cell, a timer, a starter adapted to trigger and to reset said timer, and an indicator, said timer being set to said predesignated time interval.

15. The alarm system of claim 10, wherein the walls of each of said pockets are urged together by means of leafsprings positioned in said walls.

* * * * *